US008351178B2

(12) United States Patent
Chen et al.

(10) Patent No.: US 8,351,178 B2
(45) Date of Patent: Jan. 8, 2013

(54) ELECTRONIC SYSTEM WITH SECURED DATA ACCESSING

(75) Inventors: Yen-Ting Chen, Taipei (TW); Yu-Chang Tseng, Hualien County (TW); Wen-Jeng Fang, Taipei (TW); Chih-Heng Chiu, Taipei (TW); Chung-Won Shu, Taipei (TW)

(73) Assignee: Transcend Information, Inc., NeiHu Dist, Taipei (TW)

( * ) Notice: Subject to any disclaimer, the term of this patent is extended or adjusted under 35 U.S.C. 154(b) by 378 days.

(21) Appl. No.: 12/882,229

(22) Filed: Sep. 15, 2010

(65) Prior Publication Data

US 2012/0063052 A1 Mar. 15, 2012

(51) Int. Cl.
*H01H 47/00* (2006.01)

(52) U.S. Cl. ..... 361/144

(58) Field of Classification Search ..... 361/143, 361/144; 439/38–40

See application file for complete search history.

(56) References Cited

U.S. PATENT DOCUMENTS

| | | | | |
|---|---|---|---|---|
| 5,812,356 | A | 9/1998 | O'Connor | |
| 6,528,745 | B1 * | 3/2003 | Lathrop et al. | 200/50.32 |
| 7,167,987 | B2 * | 1/2007 | Angelo | 713/186 |
| 7,351,066 | B2 | 4/2008 | DiFonzo | |

FOREIGN PATENT DOCUMENTS

EP 2026441 A1 2/2009

* cited by examiner

*Primary Examiner* — Rexford Barnie
*Assistant Examiner* — Christopher Clark
(74) *Attorney, Agent, or Firm* — Winston Hsu; Scott Margo

(57) ABSTRACT

A first electronic device includes an electromagnetic component embedded in its connecting port and controlled to be activated during data transmission between the first electronic device and a second electronic device to which the first electronic device is connecting, or during memory accessing of the first electronic device. As the electromagnetic component is activated, an attraction force exists between the two connecting ports of the first and the second electronic devices such that a user of the first electronic device will feel a resistance when he/she tries to disconnect the first electronic device from the second electronic device.

19 Claims, 4 Drawing Sheets

ELECTRONIC SYSTEM WITH SECURED DATA ACCESSING

BACKGROUND OF THE INVENTION

1. Field of the Invention

The invention relates to an electronic system, and more particularly, to an electronic system having an electromagnetic component being activated during data transmission between two electronic devices.

2. Description of the Prior Art

Electronic devices have been designed to have extensive applications by connecting/incorporating to another electronic device. Examples such as external devices, portable devices, or hub devices are provided with a multitude of connecting ports as an access end with another device, either as a host device or as a client device. Undoubtedly, it should be assured that the connecting port of the electronic device is affirmatively in electrical connection with the corresponding connecting port of another device.

For example, a conventional USB device is utilized to plug into a female USB port of a host via a male USB port. Although some basic structure is used for the USB ports to couple the two ports, it takes no hard work to unplug the USB device from the host, whether the USB device and the host are transmitting data or not. Damages to the USB drive, even to the host, may be highly possible to occur if one device is unplugged from another device when data is being transmitted, or a memory of the device is being accessed.

SUMMARY OF THE INVENTION

The invention provides an electronic system including a first electronic device and a second electronic device. The first electronic device includes a first connecting port and a first electromagnetic component embedded in the first connecting port. The second electronic device includes a ferromagnetic second connecting port. The second electronic device connects to the first electronic device by the second connecting port directly connecting to the first connecting port. The electronic system further includes a first controller coupled to the first electromagnetic component. The first controller detects whether data is being transmitted between the first electronic device and the second electronic device. When data is being transmitted between the first electronic device and the second electronic device, the first electromagnetic component is activated by the first controller to generate a first magnetic attraction force to the second connecting port.

The invention also provides an electronic system including a first electronic device and a second electronic device. The first electronic device includes a first connecting port and a first electromagnetic component embedded in the first connecting port. The second electronic device includes a ferromagnetic second connecting port. The second electronic device connects to the first electronic device by the second connecting port directly connecting to the first connecting port. The electronic system further includes a first controller coupled to the first electromagnetic component, and a memory disposed in the first electronic device or the second electronic device. The first controller detects whether the memory is being read/written. When the memory is being read/written, the first electromagnetic component is activated by the first controller to generate a first magnetic attraction force to the second connecting port.

The invention also provides an apparatus for connecting to an electronic device having a ferromagnetic first connecting port. The apparatus includes a controller, a second connecting port, and an electromagnetic component embedded in the second connecting port. When the controller detects data being transmitted between the apparatus and the electronic device, the electromagnetic component is activated by the controller to generate a magnetic attraction force to the ferromagnetic first connecting port.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
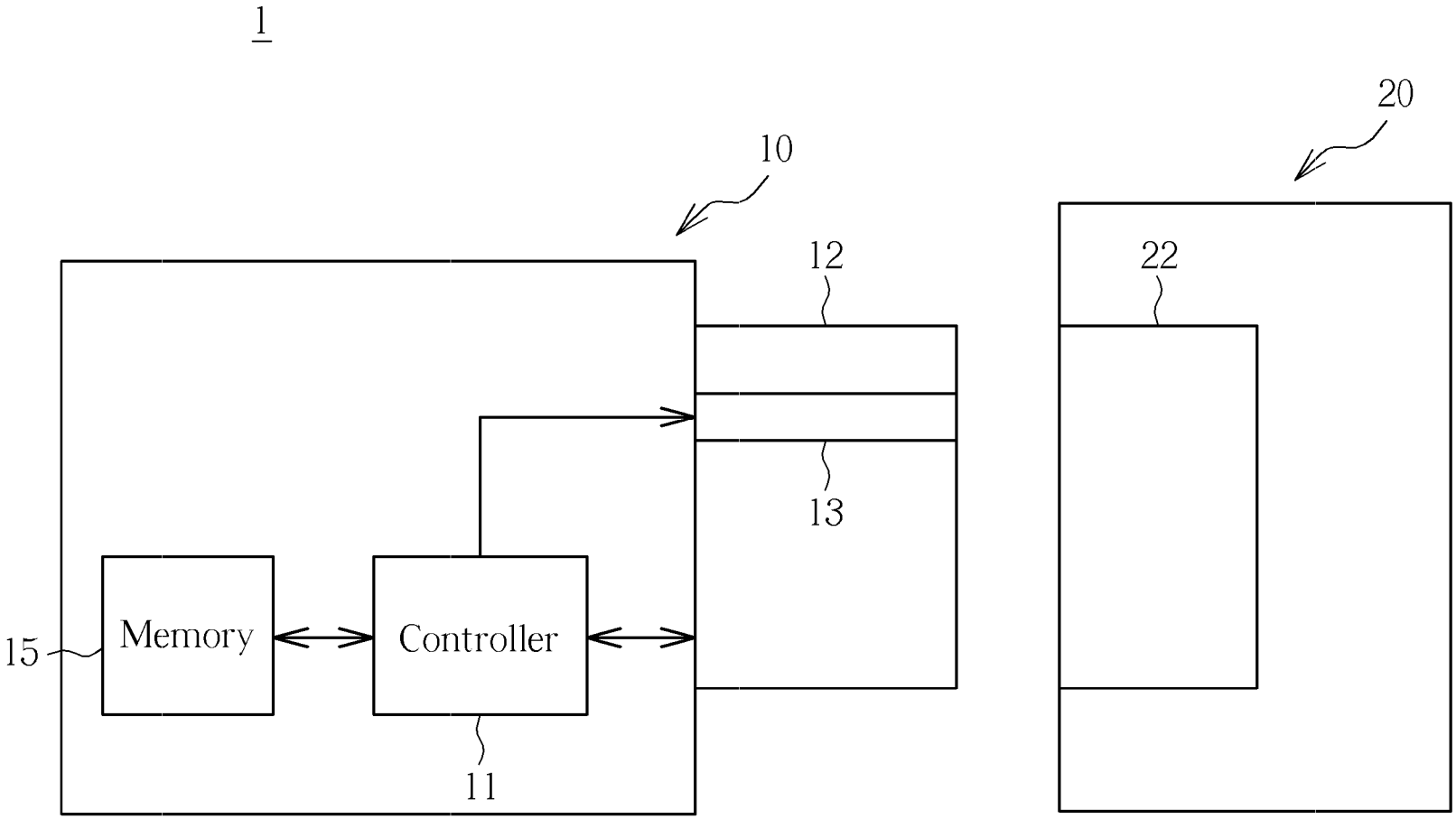
FIG. 1 illustrates a schematic diagram of a first embodiment of an electronic system according to this application.

Please refer to FIG. 1. FIG. 1 is a schematic diagram showing a first embodiment of an electronic system 1 according to this application. This application discloses any possible electronic system that includes one electronic device ready for connecting to another electronic device via various types of connecting ports. More specifically, as one electronic device of an electronic system connects to another electronic device and is currently having data transmission therebetween, a secured data accessing technique involving physical attraction force induced by an electromagnetic component between the connecting ports of the two electronic devices is implemented in this electronic system so that any person who tries to exert a force to disconnect one electronic device from the other, whether purposely or accidentally, will encounter certain resisting force as a warning.

Figure 2:
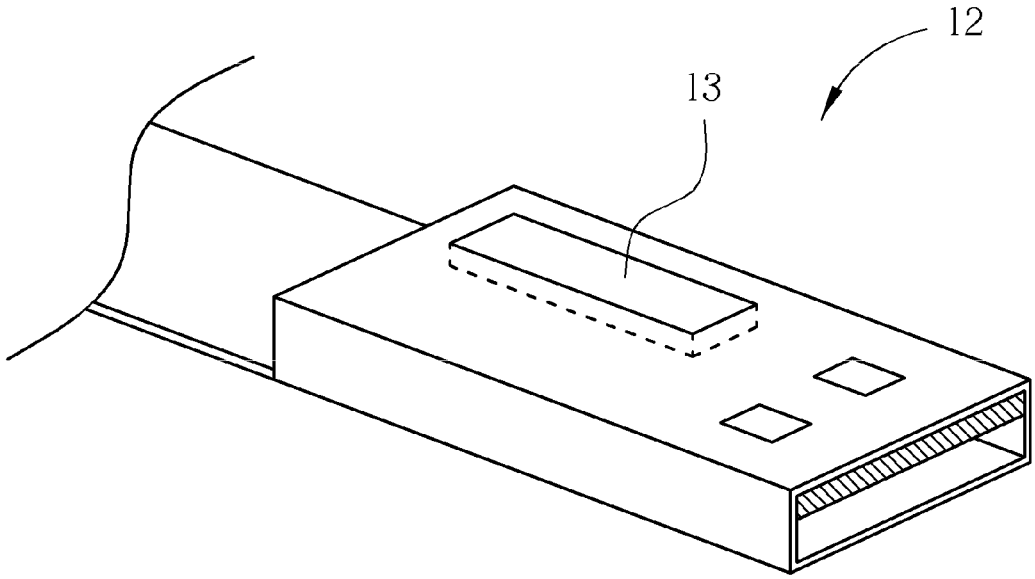
FIG. 2 illustrates a schematic diagram of an embodiment of a connecting port embedded with the electromagnetic component.

To describe this application in more detail, the first embodiment in FIG. 1 shows that the electronic system 1 includes a first electronic device 10 and a second electronic device 20. The first electronic device 10 and the second electronic device 20 may be portable devices, handheld devices, host/client computing devices, hubs, or card adapters, which may transfer data between each other and/or include memory to be read/written, and are equipped with connecting ports in order to connect one to the other. For example, as a portable device, a handheld device, a client computing device, or an external storage device (such as a pen drive or an external HDD), the first electronic device 10 includes a male first connecting port 12, an electromagnetic component 13, and a memory 15, whereas the memory 15 may also be optional and not be included in the first electronic device 10 that is implemented as a hub or a card adapter. The electronic system 1 uses a controller, which in this embodiment, a controller 11 of the first electronic device 10, coupled to the electromagnetic component 13 to detect data transmission between the first electronic device 10 and the second electronic device 20, or in other events, the controller 11 detects the read/write actions of the memory 15, while the controller may also be a control unit or an electrical circuit implemented in the second electronic device 20 to perform the detection of the data transmission via the connection between the two electronic devices 10, 20. The second electronic device 20 includes at least a second connecting port 22 for directly connecting to the first connecting port 12 such that the first electronic device 10 can be in connection with the second electronic device 20. The first connecting port 12 and the second connecting port 22 may be universal serial bus (USB) ports, IEEE 1394 ports, eSATA ports, or RS-232 serial ports. The first electronic device 10 in FIG. 1 may preferably be understood as, but not limited to, an USB portable drive with a male connecting port, as exemplary and illustrative purpose, while a different kind of portable device may also be used in this application. The electromagnetic component 13 is embedded into the first connecting port 12, preferably with integral contour with the first connecting port 12, and is controlled by the controller 11 to have magnetism under certain conditions. FIG. 2 is an example showing an embodiment of the first connecting port 12 with embedded electromagnetic component 13.

To securely protect the electronic devices 10, 20 when data transmission exists between the electronic devices 10, 20, once the controller 11 detects data is starting to transmit between the two electronic devices 10, 20, the controller activates the electromagnetic component 13 to generate a magnetic attraction force to the second connecting port 22, which is ferromagnetic in order to be attracted by the electromagnetic component 13. The magnetic attraction force, preferably between 0~20 lbs, now exists between the first connecting port 12 and the second connecting port 22 for providing a secure connection between the two electronic devices 10, 20. When the controller 11 detects that data transmission between the two electronic devices 10, 20 is terminated, the controller 11 deactivates the electromagnetic component 13, which no longer generates the magnetic attraction force to the second connecting port 22, such that the first electronic device 10 can be easily detached from the second electronic device 20.

Although the activation or the deactivation of the electromagnetic component 13 depends on the existence of data transmission between the two devices 10, 20 in the previous embodiment, the electromagnetic component 13 may also be activated and deactivated by considering whether or not the memory 15 of the first electronic device 10 is being accessed, or being read/written, since there might be some time shift between data transmission and the memory 15's being actually accessed. As a result, the electromagnetic component 13 may also be activated once the memory 15 begins to be read or the memory 15 begins to be written with data, and be deactivated once the data reading or data writing of the memory 15 is finished.

Figure 3:
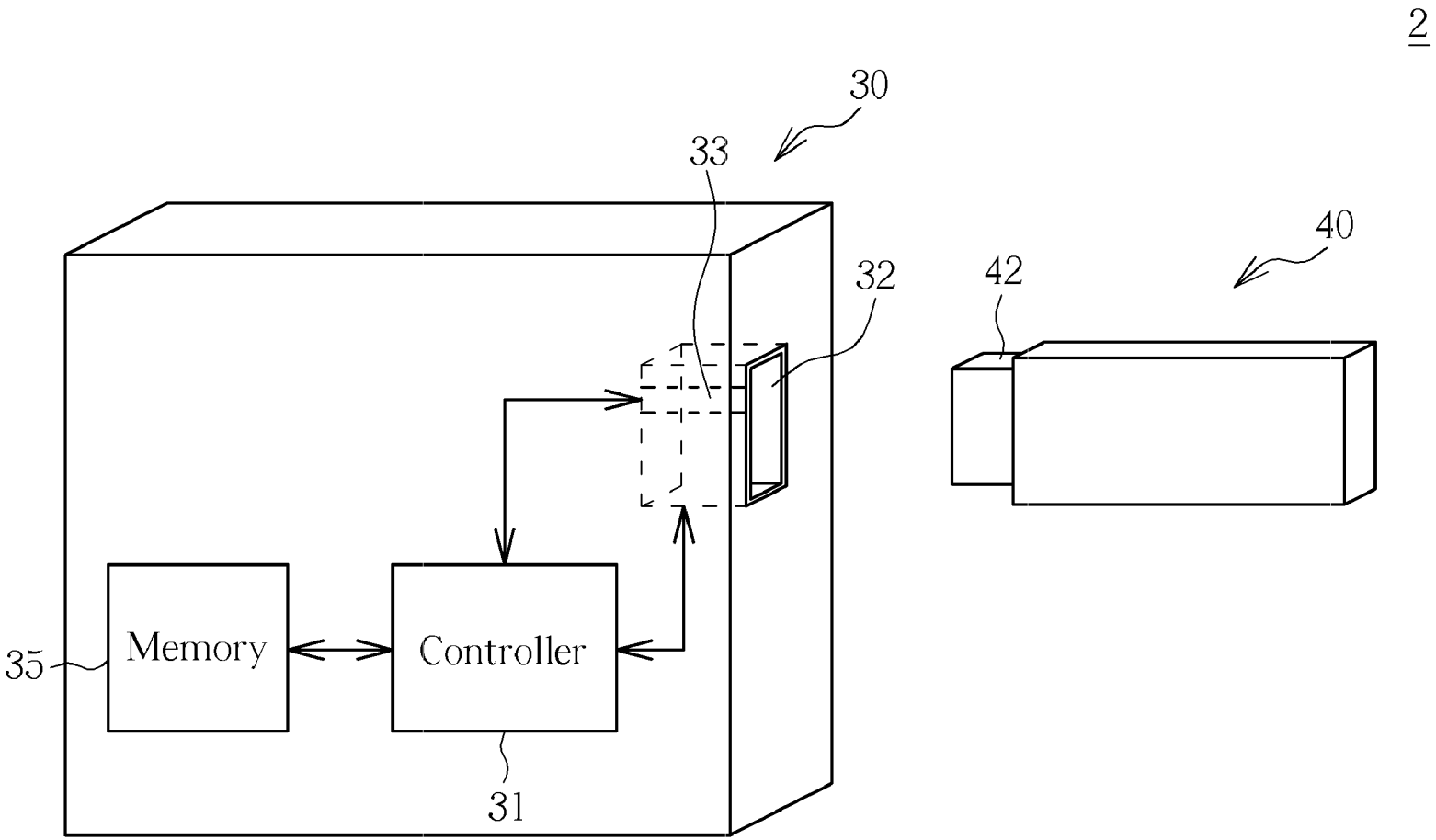
FIG. 3 illustrates a schematic diagram of a second embodiment of an electronic system according to this application.

Please refer to FIG. 3, which is a second embodiment showing an electronic system 2 according to this application. For example, as a portable device, a handheld device, a client computing device, or an external storage device (such as a pen drive or an external HDD), a first electronic device 30 of the electronic system 2 includes a ferromagnetic female first connecting port 32 with an embedded electromagnetic component 33, a controller 31, and a memory 35, whereas the memory 35 may also be optional and not be included in the first electronic device 30 that is implemented as a hub or a card adapter. The first electronic device 30 can be a host computing device, a portable device with extension ports, a hub, a card adapter, and so on. Once a second electronic device 40 plugs into the first connecting port 32 via its second connecting port 42, which is ferromagnetic, when the controller 31 of the first electronic device 30 detects that data is being transmitted between the first electronic device 30 and the second electronic device 40, or the memory 35 is being read/written, or a memory of the second electronic device 40 (not shown) is being read/written, the electromagnetic component 33 is activated by the controller 31 to generate a magnetic attraction force, preferably between 0~20 lbs, between the first connecting port 32 and the second connecting port 42. On the contrary, when the controller 31 detects that data transmission between the first electronic device 30 and the second electronic device 40 is terminated, or the memory 35 or a memory of the second electronic device 40 (not shown) is no longer being read/written, the electromagnetic component 33 will be deactivated by the controller 31, such that the magnetic attraction force no longer exists between the first connecting port 32 and the second connecting port 42 and the second electronic device 40 can be easily detached from the first electronic device 30.

Figure 4:
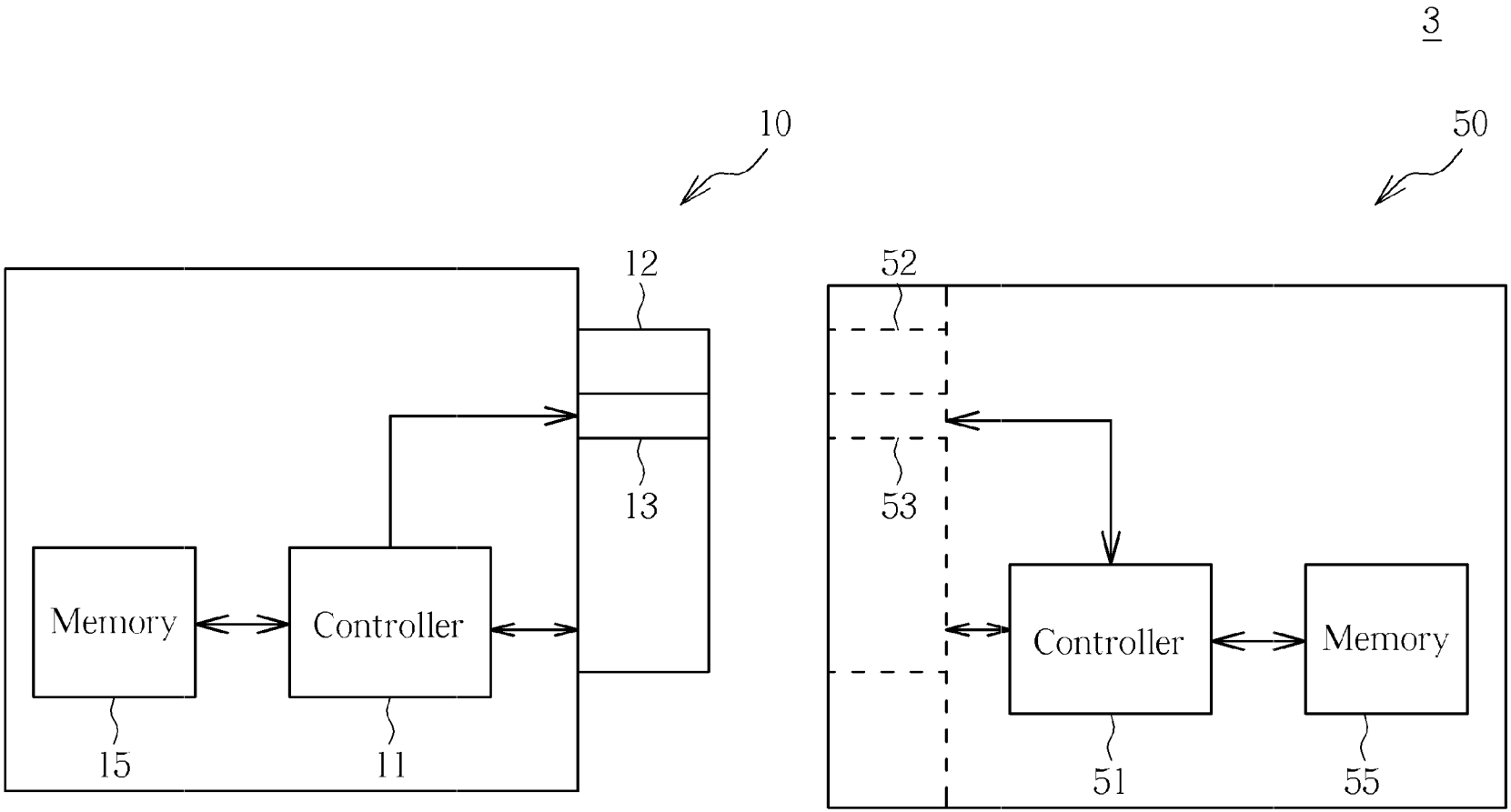
FIG. 4 illustrates a schematic diagram of a third embodiment of an electronic system according to this application.

Please refer to FIG. 4. FIG. 4 is a schematic diagram showing a third embodiment of an electronic system 3 according to this application. The electronic system 3 includes a first electronic device 10 as the one in the first embodiment and a second electronic device 50 as the first electronic device 30 in the second embodiment. The third embodiment of this application shows that, as both electronic devices 10, 50, whose connecting ports 12, 52 are both ferromagnetic and embedded with an electromagnetic component, connect with each other via a male connecting port 12 and a female connecting port 52, the electromagnetic components 13, 53 of the two electronic devices 10, 50 may have only one or both of them activated and deactivated according to the existence of data transmission or read/written of the memory 15 and/or the memory 55, where the memories 15, 55 may be optional for similar implementing conditions as previously described in the first and second embodiments. As for both the electromagnetic components 13, 53 activated/deactivated implementation, the two electromagnetic components 13, 53 are controlled to have opposite magnetic polarities once they are activated by the corresponding controllers 11, 51. For example, the electromagnetic component 13 may be activated to generate a first magnetic attraction force and the electromagnetic component 53 may be activated to generate a second magnetic attraction force, and since the two magnetic attraction forces have opposite polarities, the sum of the two magnetic attraction forces is preferably within 0~20 lbs.

The application discloses embodiments that show a first electronic device including an electromagnetic component embedded in its connecting port and controlled to be activated during data transmission between the first electronic device and a second electronic device to which the first electronic device is connecting, or during memory accessing of the first electronic device. As the electromagnetic component is activated, an attraction force exists between the two connecting ports of the first and the second electronic devices such that a user of the first electronic device will feel a resistance when he/she tries to disconnect the first electronic device from the second electronic device.

Those skilled in the art will readily observe that numerous modifications and alterations of the device and method may be made while retaining the teachings of the invention.

What is claimed is:

1. An electronic system, comprising:

a first electronic device comprising a first connecting port and a first electromagnetic component embedded in the first connecting port; and a second electronic device comprising a ferromagnetic second connecting port, wherein the second electronic device connects to the first electronic device by the second connecting port directly connecting to the first connecting port;

wherein the electronic system further comprises a first controller coupled to the first electromagnetic component, the first controller detecting whether data is being transmitted between the first electronic device and the second electronic device, and when data is being transmitted between the first electronic device and the second electronic device, the first electromagnetic component is activated by the first controller to generate a first magnetic attraction force to the second connecting port.

2. The electronic system of claim 1, wherein the first magnetic attraction force is between 0 and 20 lbs.

3. The electronic system of claim 1, wherein the first connecting port is ferromagnetic and the electronic system further comprises a second electromagnetic component embedded in the second connecting port and a second controller coupled to the second electromagnetic component to detect whether data is being transmitted between the first electronic device and the second electronic device;

wherein when data is being transmitted between the first electronic device and the second electronic device, the second electromagnetic component is activated by the second controller to generate a second magnetic attraction force to the first connecting port, and the first electromagnetic component and the second electromagnetic component have opposite magnetic polarities.

4. The electronic system of claim 3, wherein the sum of the first magnetic attraction force and the second magnetic attraction force is between 0 and 20 lbs.

5. The electronic system of claim 1, wherein at least one of the first electronic device and the second electronic device is a data storage device.

6. The electronic system of claim 1, wherein the first electronic device is a card adapter.

7. The electronic system of claim 1, wherein the first electronic device is a hub.

8. The electronic system of claim 1, wherein the first connecting port is a universal serial bus (USB) port, an IEEE 1394 port, an eSATA port, or an RS-232 serial port, and the second connecting port is a connecting port corresponding to the first connecting port.

9. An electronic system, comprising:

a first electronic device comprising a first connecting port and a first electromagnetic component embedded in the first connecting port; and a second electronic device comprising a ferromagnetic second connecting port, wherein the second electronic device connects to the first electronic device by the second connecting port directly connecting to the first connecting port;

wherein the electronic system further comprises a first controller coupled to the first electromagnetic component, and a memory disposed in the first electronic device or the second electronic device, the first controller detecting whether the memory is being read/written, and when the memory is being read/written, the first electromagnetic component is activated by the first controller to generate a first magnetic attraction force to the second connecting port.

10. The electronic system of claim 9, wherein the first magnetic attraction force is between 0 and 20 lbs.

11. The electronic system of claim 9, wherein the first connecting port is ferromagnetic and the electronic system further comprises a second electromagnetic component embedded in the second connecting port and a second controller coupled to the second electromagnetic component to detect whether the memory is being read/written;

wherein when the memory is being read/written, the second electromagnetic component is activated by the second controller to generate a second magnetic attraction force to the first connecting port, and the first electromagnetic component and the second electromagnetic component have opposite magnetic polarities.

12. The electronic system of claim 11, wherein the sum of the first magnetic attraction force and the second magnetic attraction force is between 0 and 20 lbs.

13. The electronic system of claim 9, wherein at lease one of the first electronic device and the second electronic device is a data storage device.

14. The electronic system of claim 9, wherein the first connecting port is a universal serial bus (USB) port, an IEEE 1394 port, an eSATA port, or an RS-232 serial port, and the second connecting port is a connecting port corresponding to the first connecting port.

15. An apparatus for connecting to an electronic device having a ferromagnetic first connecting port, the apparatus comprising a controller, a second connecting port, and an electromagnetic component embedded in the second connecting port, wherein when the controller detects data being transmitted between the apparatus and the electronic device, the electromagnetic component is activated by the controller to generate a magnetic attraction force to the ferromagnetic first connecting port.

16. The apparatus of claim 15, wherein the apparatus is a data storage device.

17. The electronic system of claim 15, wherein the first electronic device is a card adapter.

18. The electronic system of claim 15, wherein the first electronic device is a hub.

19. The apparatus of claim 15, wherein the second connecting port is a universal serial bus (USB) port, an IEEE 1394 port, an eSATA port, or an RS-232 serial port.

* * * * *